US008144030B1

(12) United States Patent
Lipke

(10) Patent No.: US 8,144,030 B1
(45) Date of Patent: Mar. 27, 2012

(54) PERSONAL SIGNAL DEVICE WITH AUTOMATIC SWITCHING BASED ON ORIENTATION

(76) Inventor: Douglas D. Lipke, Evergreen, CO (US)

( * ) Notice: Subject to any disclaimer, the term of this patent is extended or adjusted under 35 U.S.C. 154(b) by 584 days.

(21) Appl. No.: 12/401,309

(22) Filed: Mar. 10, 2009

Related U.S. Application Data

(60) Provisional application No. 61/068,678, filed on Mar. 10, 2008.

(51) Int. Cl.
*G08G 1/095* (2006.01)

(52) U.S. Cl. ..... 340/908; 340/907; 340/815.45; 116/63 R

(58) Field of Classification Search ..... 340/907, 340/908, 815.45; 116/63 R
See application file for complete search history.

(56) References Cited

U.S. PATENT DOCUMENTS

| | | | | |
|---|---|---|---|---|
| 3,867,775 | A * | 2/1975 | Lapham et al. | 40/610 |
| 4,709,307 | A * | 11/1987 | Branom | 362/103 |
| 6,118,388 | A * | 9/2000 | Morrison | 340/908 |
| 6,709,142 | B2 * | 3/2004 | Gyori | 362/554 |

* cited by examiner

*Primary Examiner* — Travis Hunnings
(74) *Attorney, Agent, or Firm* — Leyendecker and Lemire, LLC; Kurt Leyendecker

(57) ABSTRACT

A personal signal device for automatically displaying one of a plurality of patterns automatically based on the orientation of the device, such as is useful in the direction of vehicular traffic, is described. The device typically comprises a plurality of lights, often high intensity LEDs, an orientation sensor and a controller that illuminates a portion of the LEDs depending upon the orientation information provided by the sensor. The device can be adapted to couple to a user's arm or hand such as being coupled with a glove.

20 Claims, 12 Drawing Sheets

PERSONAL SIGNAL DEVICE WITH AUTOMATIC SWITCHING BASED ON ORIENTATION

CROSS REFERENCE TO RELATED APPLICATIONS

The present invention is a Non-Provisional Application of U.S. Provisional Application No. 61/068,678 filed on Mar. 10, 2008 having the same named inventor. The parent application is incorporated herein by reference.

FIELD OF THE INVENTION

The present invention pertains to signal devices and their methods of use. Particular uses can include, but are not limited to, traffic control, crowd control, aircraft guidance while the aircraft is on the ground and docking guidance for trucks and other vehicles.

BACKGROUND

On occasion, police officers and other people need to direct traffic to maintain safety and an acceptable rate of flow. These instances may occur when (i) a traffic light is down, (ii) vehicular density is particularly high, such after a mass attendance event, (iii) construction or road repair compromises the normal free flow of traffic, and (iv) an accident has occurred hindering the free flow of traffic.

Typically, an officer stands in the road or on the side of the road often in the flow of traffic itself and using hand signals directs the movement of vehicles. If drivers do not see him/her, they may ignore his/her signaling and continue on possibly endangering themselves, pedestrians and/or the occupants of other vehicles. Even more significantly, the officer can be struck, injured or killed if the driver does not see him or her. Statistics indicate that traffic duty is one of the most dangerous tasks a police officer can perform.

To improve officer visibility, they can be provided with reflective, brightly colored vests or other suitable apparel. They may be given large paddles perhaps imprinted with a stop sign image on one side and "go" or "proceed" image on the other side to increase their visibility to motorists. Nevertheless, the inherent risks to the officer remain. Others who direct traffic, such as construction workers and crossing guards, are also subject to the same risks.

DETAILED DESCRIPTION

Figure 1:
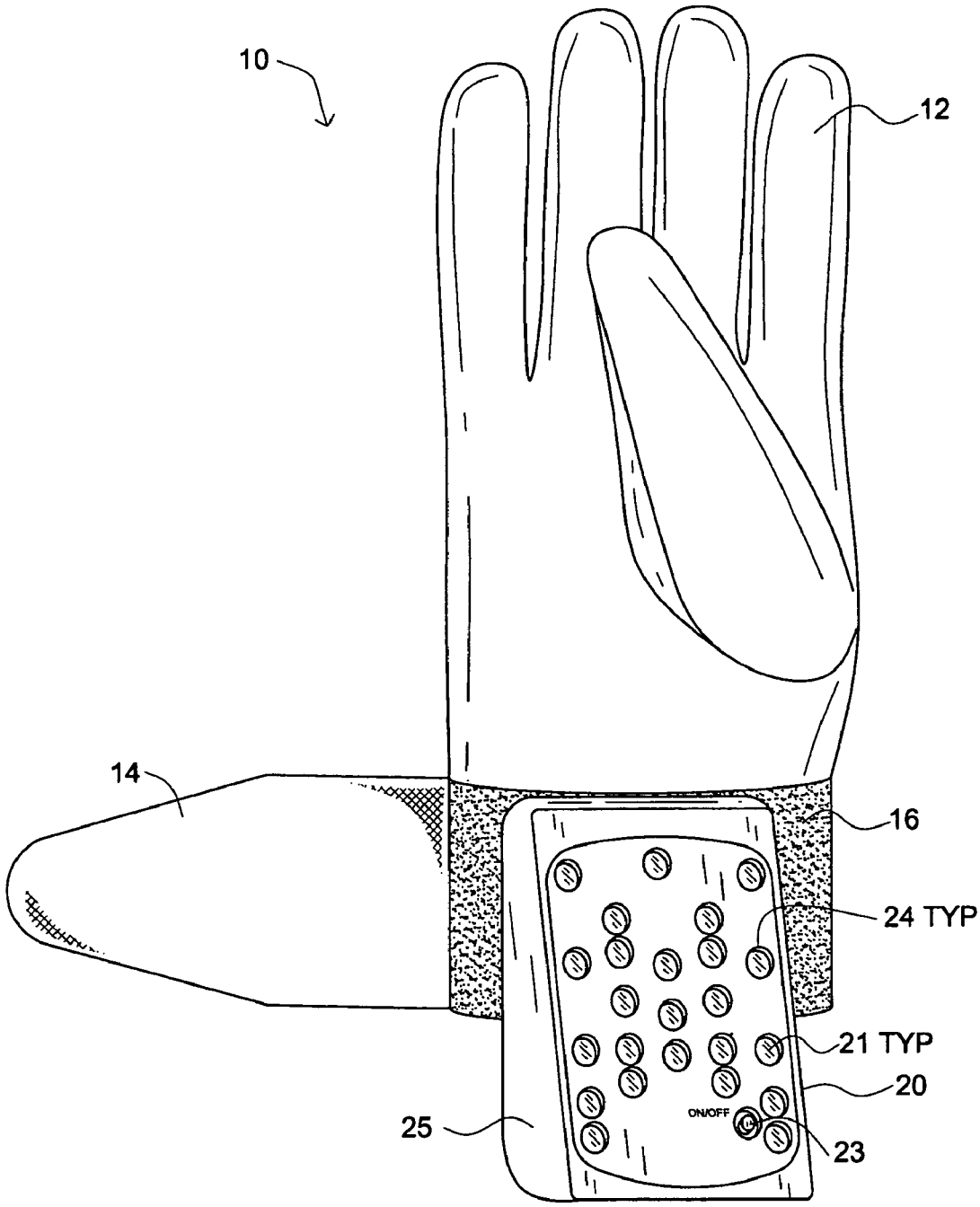
FIG. 1 is an isometric view of a personal signal device incorporating a glove according to one embodiment of the present invention.

Embodiments of the present invention comprise a personal signal device for use by police officers or other people in the control and direction of vehicular traffic or any other use that involves signaling another by movement of the hands, arms or other appendages. Embodiments of the device comprise a plurality of lights, often high intensity LEDs (Light Emitting Diodes), that automatically illuminate different patterns depending upon the orientation of the signal device. For instance, in one variation a set or portion of the lights illuminate to form an "X" when the device is held in an upward or vertical direction to indicate that an oncoming motorist should stop; whereas, another section or portion of the lights illuminate to form a directional arrow when the device is orientated sideways or laterally to indicate that an oncoming motorist is free to turn in a particular direction. In some variations, the illuminated patterns flash or are otherwise animated to further draw attention thereto.

The high-intensity of the illuminated lights often combined with the animated nature of a particular illuminated pattern draws attention to both the personal signal device and the person using the device. In variations, the lights are bright enough that they are easily visible even during the brightest part of the day.

Further, the patterns illuminated on embodiments, depending on its orientation, reinforce the action the officer wearing the device desires the motorist to take. For instance in at least one embodiment, a red "X" pattern reinforces the officer's hand and arm gesture that the approaching car is to stop lessoning any confusion on the part of the motorist in the approaching car. Similarly, an animated green arrow indicating a particular direction reinforces the officer's gesture that the approaching car should turn in the direction that the arrow is pointing.

In some embodiments, a signaling unit is incorporated into a glove that is worn on an officer's hand. Typically, the signaling unit is positioned on the palm side of the hand with the front side of the unit, which includes the plurality of lights, facing away from the user's palm. Accordingly, an officer can direct traffic in a traditional manner without having to dramatically adjust because he or she is wearing a personal signal device. In other words, an officer requires little if any special training to use the signal device.

The location where the signaling unit is attached to the palm side of the glove can vary as well. In some embodiments, the signaling unit is attached to the glove directly above the palm. However, in the illustrated embodiments, the signaling unit is attached to the cuff of the glove. Moreover, it extends downwardly and outwardly of the palm portion of the glove such that it does not appreciably hinder an officer's ability to use the associated hand in a normal manner. For example, the location of the signaling unit permits the officer to draw his/her handgun or wield a nightstick as might be required in some circumstances.

Other embodiments are contemplated as well wherein a signaling unit need not be coupled with the glove, but rather can be attached by other means with an officer's hand or forearm. For instance, a signaling unit can include straps that wrap around a user's forearm or wrist to hold the device in place. In another embodiment, as is illustrated here in, the personal signal device can comprise a paddle that is held in the hand. By changing the orientation of the paddle, the illuminated pattern changes automatically.

The electronic circuitry provided in the signaling unit can vary between embodiments as can the nature of an orientation sensor utilized to determine the relative position of the unit. For instance in one variation, one or more mercury switches can be utilized to switch on and switch off differing illuminated patterns of lights. In the illustrated embodiment, however, a MEMS (micro-electro-mechanical systems) orientation sensor is utilized to determine the relative orientation of the unit and a microcontroller is employed to switch on and off the various illuminated patterns based on the signal received from the MEMS. No matter the particular design of the circuitry, the signaling unit will switch automatically between various illuminated patterns based solely upon its orientation, which is related to the position of the officer's arm and/or hand.

In other alternate embodiments multiple MEMS sensors may be utilized, their orientation within the device in different planes. Accordingly, the device can sense more complex changes in orientation and provide an illuminated output that corresponds with those differing multiple axis orientations. It is further appreciated that while the invention is described primarily in relation to traffic management and for use by police officers, other embodiments can be used by people in other professions as well. Some of those professionals include: cyclists to augment hand signaling; firemen; crossing guards; EMTs (emergency medical technicians); public safety officers; school traffic control personnel; air traffic controllers; parking event workers; military and government personnel and others. Depending on a particular use, the arrangements of the lights may vary as well as the patterns illuminated when the signal device is placed in particular orientations. Further, signaling units can be produced that attach to other parts of the body wherein signaling an orientation change form that particular body part would be useful to an onlooker.

Some embodiments of the present invention further incorporate wireless transmitters or transceivers and associated circuitry that permit their use in conjunction with secondary or auxiliary signal devices. For example as is discussed in greater detail below, a traffic cone may be provided that has an auxiliary signaling device mounted on top of it. The auxiliary signaling device will typically include a wireless receiver that receives instructions from the primary personal signal device. Accordingly, an officer directing traffic can set up one or more traffic cones that include the auxiliary signal devices and illuminate in a manner consistent with his hand and arm gestures further increasing the probability that an oncoming motorist will see and heed the officer's direction.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning: either or both.

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, "left", "right", "nadir", "apex", "top", "bottom", "vertical", "horizontal", "back", "front" and "lateral" are relative to each other and are dependent on the specific orientation of an applicable element or article, and are used accordingly to aid in the description of the various embodiments and are not necessarily intended to be construed as limiting.

As applicable, the terms "about" and "generally" as used herein unless otherwise indicated mean a margin of +−20%. Also, as applicable, the term "substantially" as used herein unless otherwise indicated means a margin of +−10%. Concerning angular measurements, "about" or "generally" refer to +−10 degrees and "substantially" refers to +−5.0 degrees unless otherwise indicated. It is to be appreciated that not all uses of the above terms are quantifiable such that the referenced ranges can be applied.

As used herein unless clearly indicated otherwise in context, the term "glove" and it obvious variants refers to any article of clothing designed to be worn over a hand that covers a portion of the hand. The foregoing definition encompasses but is not limited to traditional fingered style gloves, mittens, fingerless-style gloves. Unless otherwise clearly indicated in context, a "glove" includes a rear side adapted to cover at least a portion of a back side of a person's hand, a front side adapted to cover at least a portion of the person's palm, and a cuff that is adapted to extend around the person's arm proximate a wrist when worn. The cuff may be, but is not necessarily, adjustable for arms having differing circumferences.

As used herein unless clearly indicated otherwise in context, "arm attachment means" refers to any suitable means for attaching an associated article or device to an arm of a person anywhere between the elbow and the tips of the forgers. The "arm attachment means" includes gloves, tubular sleeves, straps with closures, adhesives and the functional equivalents of the foregoing. Closures for straps include but are not limited to hook and loop material, buckles, buttons, snaps, clasps, clamps and adhesive.

As used herein unless clearly indicated otherwise in context, an "orientation sensor" comprises any component for use in electrical circuits that senses or reads its position and/or orientation relative to a reference direction and/or orientation. The "orientation sensor" is not to be considered limited to any particular technology; however, it can be as simple as one or more mercury switches that turn a circuit on or off depending on their positions, or alternatively, it can comprise a micro-electro-mechanical systems (MEMS) device. Two or more differently orientated MEMS orientation sensors can be used in some variations to measure the orientations of the device in several planes. Where a MEMS orientation sensor is utilized digital or analog signal information is typically sent to a controller which activates or deactivates features of the associated device based on the information.

As used herein unless clearly indicated otherwise in context the terms "transmitter", "receiver" and "transceiver" refer to wireless transmitters and receivers that operate in the electromagnetic spectrum including but not limited to RF and infrared.

Embodiments of a Personal Signal Device Incorporating a Glove

Figure 2:
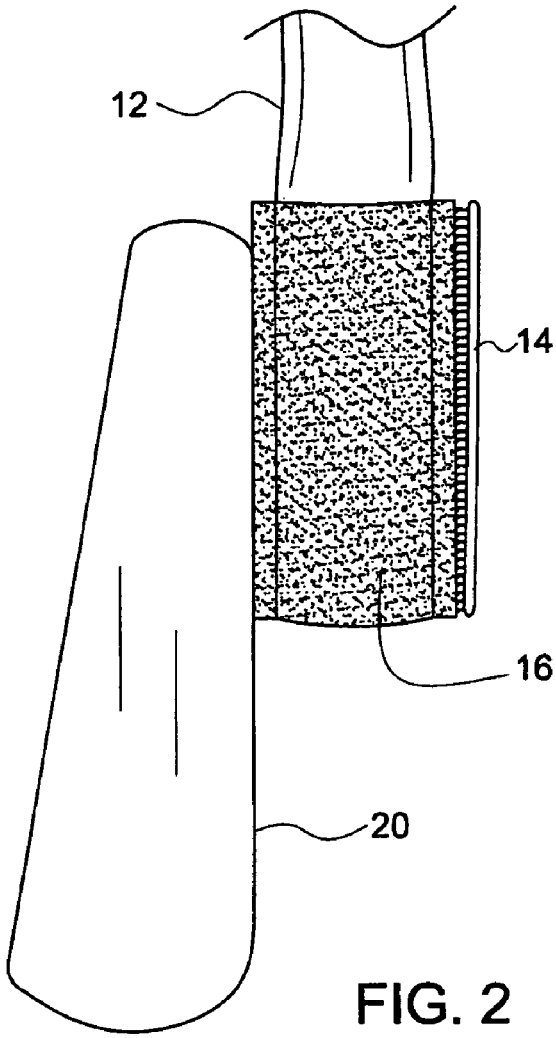
FIG. 2 is a partial side view of a personal signal device according to one embodiment of the present invention.

Referring primarily to FIGS. 1 & 2, an embodiment of a personal signaling device 10 incorporating a glove is illustrated. The primary components and elements of the device include: a glove 12 including a wide adjustable cuff; and a signaling unit 20 attached with a cuff and having a plurality of LED lights 21 distributed on a front face.

The glove 12 can be of any suitable design and configuration. In one variation, the glove comprises a black brushed leather front or palm side with the backside comprised of a florescent colored fabric with several reflective strips disposed there on. As illustrated, the glove includes five fingers to receive the digits of a typical human hand. Additionally, the base of the glove includes a wide cuff comprised of a strap or ribbon assembly 16. The cuff strap assembly includes at least a portion of its backside comprising a loop material. The cuff also includes a closure strap 14 that wraps over the loop material. The closure strap includes hook material on an inside surface for coupling and connecting with the corresponding loop material. Accordingly, a user can adjust the relative tightness of the cuff around the portion of his or her arm proximate the wrist.

In one embodiment, the strap assembly 16 comprises two layers of a loop material having a woven ribbon base. The layers are sewn together with the loop material faces facing outwardly to provide both a soft surface that comes in contact with the skin of a user and the requisite surface on the outside of the cuff for receiving and securing the hook material of the closure strap 16. By combining two layers, the signaling unit can be mechanically attached to the outermost layer using rivets or other fasteners (not shown) without the fasters coming in direct contact with the user's skin. The strap utilized in the illustrated embodiment is about 1½ to 2½" wide and more preferably about 1¾" wide.

Figure 3:
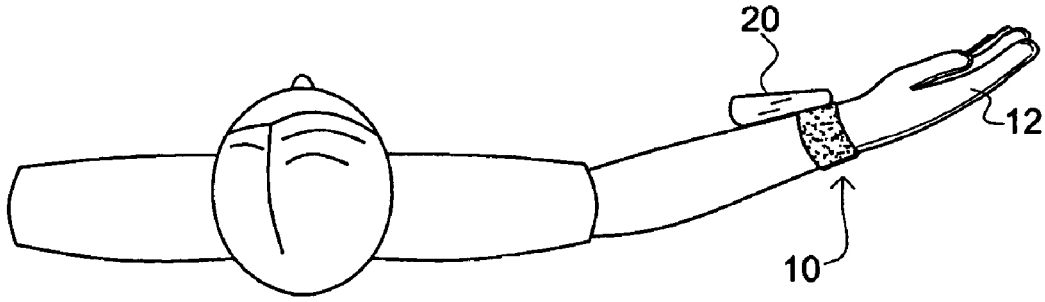
FIG. 3 is top view of a person wearing the personal signal device according to one embodiment of the present invention.

As illustrated best in FIG. 2, an upper half of the backside of the signaling unit 20 is mounted to the cuff on the palm side of the glove 12. The bottom half of the signaling unit is cantilevered below the bottom edge of the cuff. Accordingly, when worn the signaling unit 20 does not appreciably interfere with the user's ability to use the associated hand as best shown in FIG. 3. In other words, the signaling unit extends away from the user's palm. As mentioned above, this can be important for a police officer who, depending on the situation, finds himself in a situation where he may be required to draw a weapon. Because the signaling unit is attached to the cuff strap assembly 16 over a wide width and because the strap assembly can be tightly secured around the user's wrist, the signaling unit does not droop appreciably when laterally disposed, such as shown in FIG. 3 wherein the illustrated user is directing a motorist to make a right turn.

The signaling unit 20 typically comprises a housing 22 in which is enclosed the circuitry relating to the automatic operation of the device and the illumination of the lights 21 in a variety of patterns depending on the orientation of the unit. The housing is typically fabricated of a suitable plastic material having a front side, a backside and sidewalls adjoining the two.

Of note, the front side, which includes a plurality of LED apertures 24, is canted at an acute angle relative to the backside. The purpose of this is made evident in FIG. 3. When a person holds his arms laterally outwardly they are typically angled forwardly a small amount. The acute angle between the front side and the backside compensates for this tendency such that the front face of the signaling unit is positioned generally perpendicularly to the direction of travel of oncoming traffic. Specifically, the backside of the housing rests generally flush against a user's forearm. The forearm is typically angled forwardly relative to the user's body. The front face of the unit is therefore angled at amount approximately opposite of the angle of the forearm resulting in a front face that is generally parallel with the user's body and generally perpendicular to the direction of the oncoming traffic. The foregoing helps ensure maximum visibility of the illuminated patterns by oncoming motorists.

Figure 4:
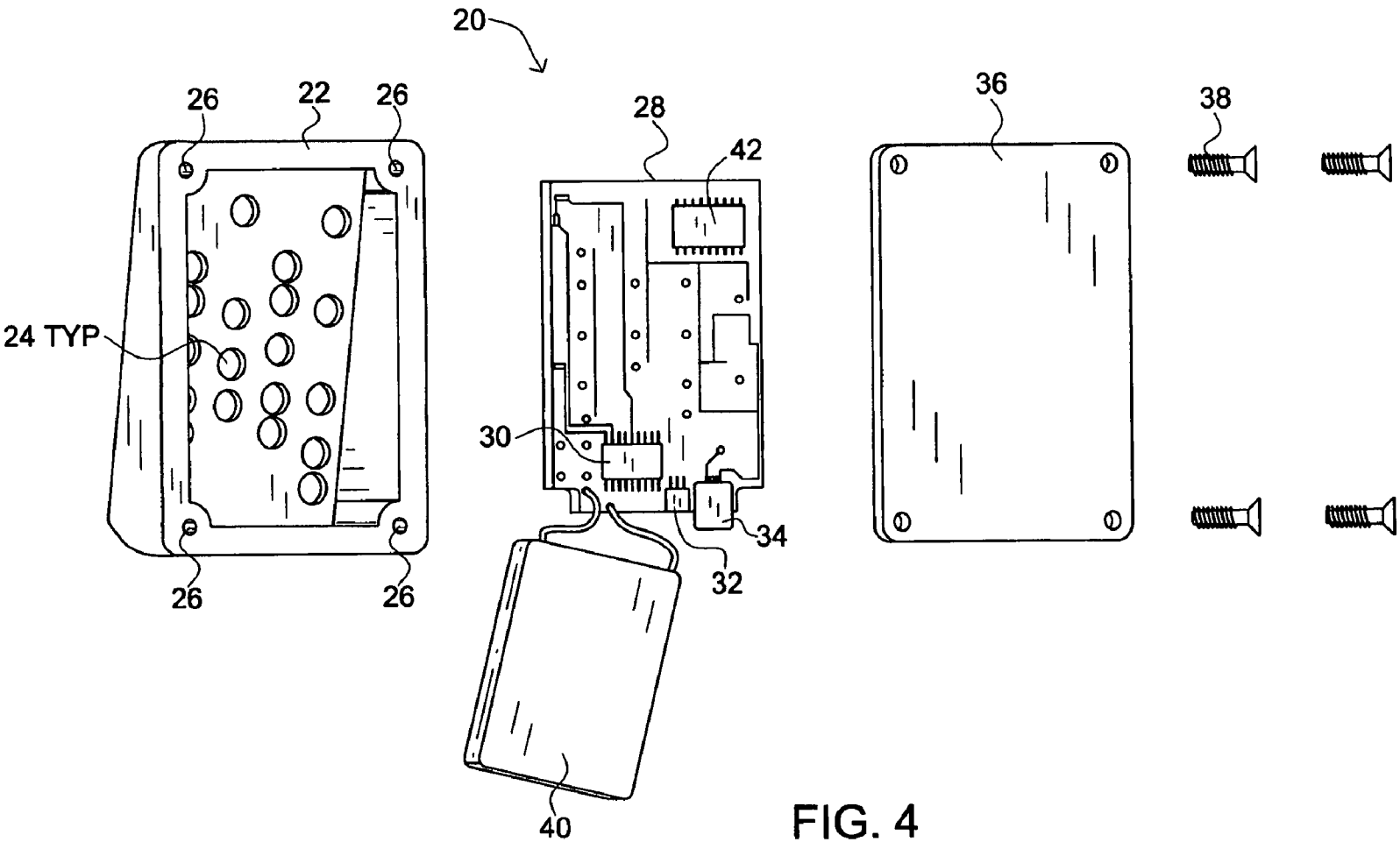
FIG. 4 is an exploded isometric view of a signaling unit from the personal signal device according to one embodiment of the present invention.

FIG. 4 is an exploded view of the signaling unit 20. The housing 25 comprises a front portion 22 forming an internal cavity and the back plate 36. As illustrated, the front face as viewed herein from its backside comprises a plurality of apertures 24 through which LEDs located on the front side (not shown in FIG. 4) of a circuit board 28 are aligned when the unit is assembled. The internal cavity is sized to contain the circuit board 28 and an associated rechargeable battery 40. The interior cavity is further configured to hold the circuit board at essentially the same angle as the front face/side of the unit. In other words, the circuit board is held in a position parallel to the front side.

The internal cavity is enclosed using the back plate 36 which is attached to the front portion by way of a plurality of screws 38 or other suitable fasteners received in threaded openings 26. The housing can be made of any suitable material but is typically comprised of plastic formed using any suitable manufacturing technology including but not limited to injection molding, reaction molding and vacuum molding. It is to be appreciated that the configuration of the case can change in other variations. For instance a variation is contemplated wherein front and rear portions sections thereof are split about midway along the sidewalls and they are joined to form the internal cavity. The front and back sections can be joined by various modalities including the aforementioned fasteners and snap together appendages and recesses molded into the sections.

Figure 5:
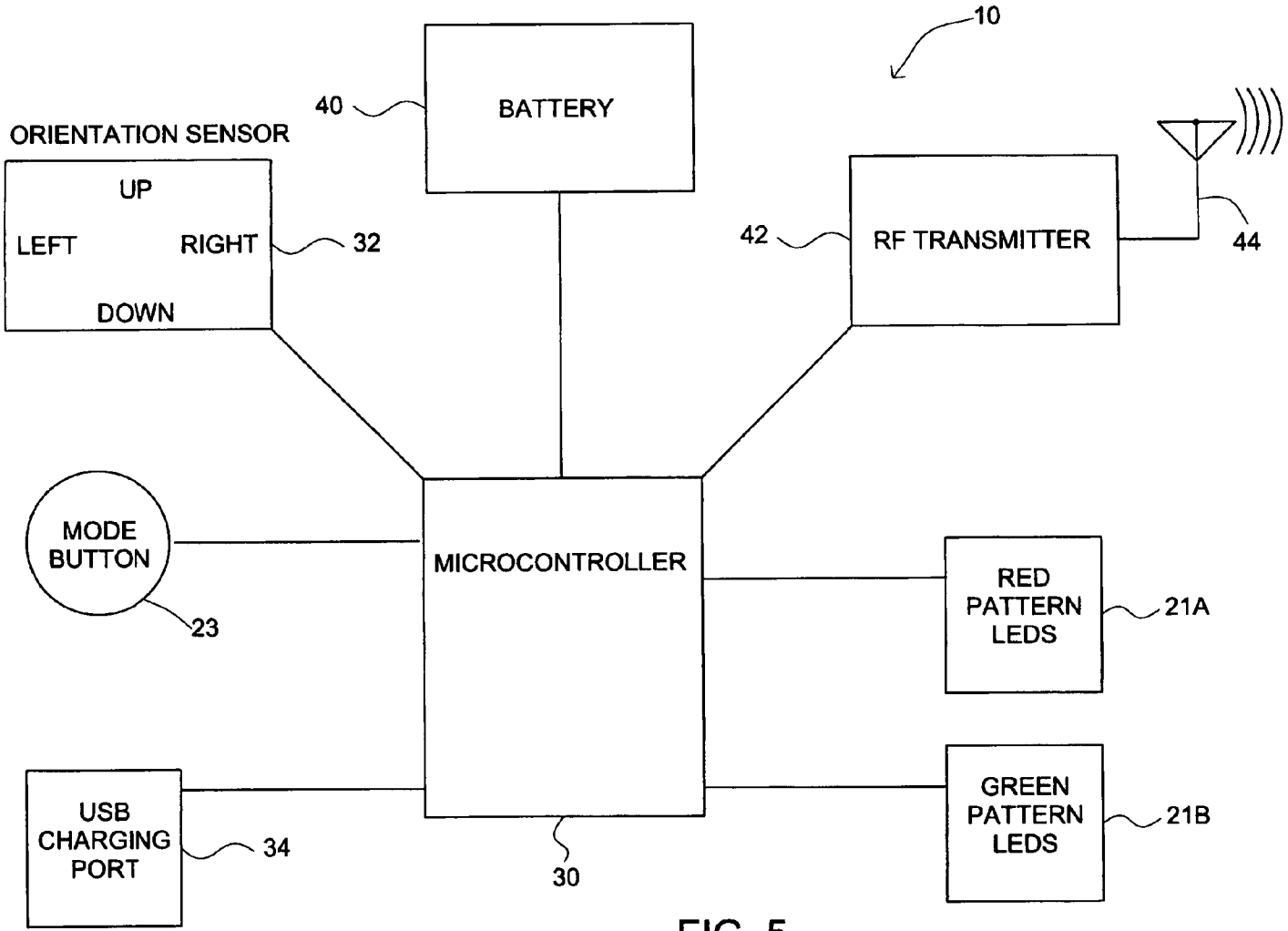
FIG. 5 is a block diagram of the electronic circuit for the signaling unit according to one embodiment of the present invention.

With primary reference to FIGS. 4 and 5, the configuration of the circuit board 28 of one embodiment and the associated electronic circuitry is described herein. As can be appreciated, however, other circuits are contemplated that can offer similar functionality. For instance, a variation is contemplated that does not utilize a microcontroller but employs mercury switches to turn off and on different illuminated patterns depending on the orientation of the device relative to the direction of gravity.

Figure 9:
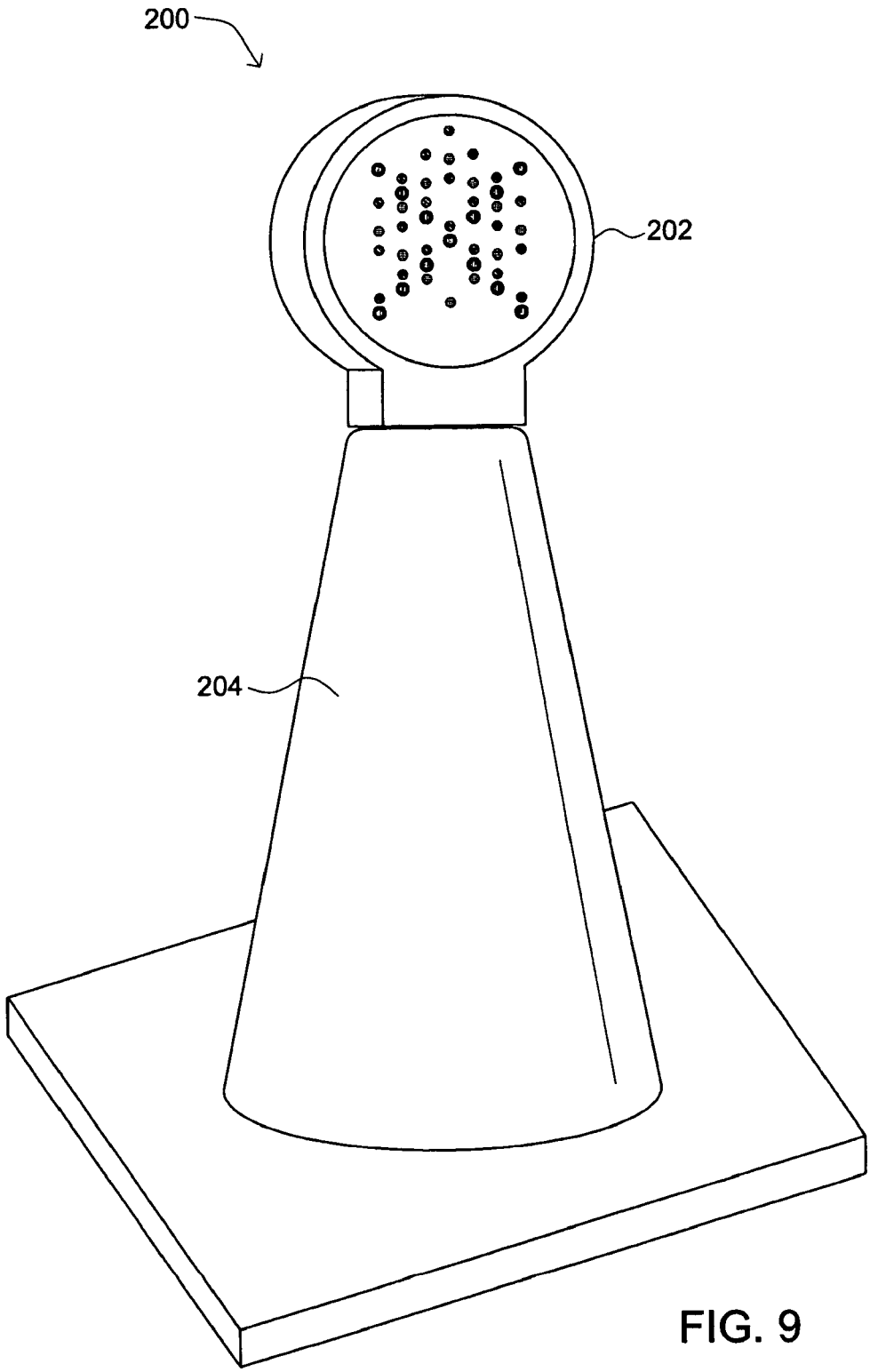
FIG. 9 is an isometric view of a signal device attached to the top of a traffic cone according to one embodiment of the present invention.

Referring to FIG. 5, the circuit typically includes: a microcontroller 30; a power source 40, typically a rechargeable battery 40; a plurality of lights 21A&B, typically LEDs, in one or more colors; a charging port 34, which in some variations can also be configured to facilitate a person to reprogram and/or set operational parameters for the unit; and a mode button 23 (see FIG. 1) for switching the device on and off as well as switching the devices between different operational modes, if any. Some variations can also include a wireless transmitter 44 or transceiver for transmitting signals to a secondary or slave device, such as a cone-mounted signal device 200 as shown in FIG. 9.

The microcontroller 30 is usually but not necessarily resident on a single integrated circuit chip. Typically, the microcontroller is pre-programmed to control the operation of the LEDs 21A & B depending on the nature of signals received from the MEMS orientation sensor 32. The microcontroller can also be configured to control the wireless transmitter 44 in variations so equipped. The operation of a typical microcontroller is illustrated in the flow chart of FIG. 6, which is described in detail below.

A power supply, typically a rechargeable battery 40 of a suitable capacity and voltage, is coupled to the microcontroller 30, as well as, directly or indirectly with the various other powered elements of the circuit. In one embodiment, a lithium poly battery is utilized but other types can be utilized as well. The microcontroller can also be configured to control the re-charging of the battery or distinct charging circuitry can be provided bypassing the microcontroller for that function. To facilitate charging, the charging port 34 is provided, which in the illustrated embodiment comprises a USB-type port. As can be appreciated, the USB port can be configured in some variations only for power supply and recharging duties; whereas, in other variations the port may include data transfer capabilities so that a user can configure the signal device and/or reprogram its operation.

The MEMS orientation sensor 32 is configured to determine its relative orientation within a predetermined plane relative to the direction of gravity. One suitable sensor is made by Sharp Corp. and identified as part no. GP1S036HEZ, although other orientation sensors can be utilized depending on the particular design of the circuit and the signaling unit. Based on the signal received from the sensor, the microprocessor determines which LED pattern to illuminate.

A plurality of pre-arranged lights, most typically LEDs 21A&B, are provided on the front face of the signaling unit. The LEDs are typically of the ultra bright type such that they can be easily seen even during the day. The lights are typically soldered or otherwise operationally coupled to the front side of the circuit board 28 (the back side thereof is illustrated in FIG. 4 although a simplified rendition of the front side of the circuit board is shown in FIGS. 7 & 8A-C). The particular arrangement of LEDs and the various colors of the LEDs depend on the illuminated patterns the unit is configured to display.

Figure 7:
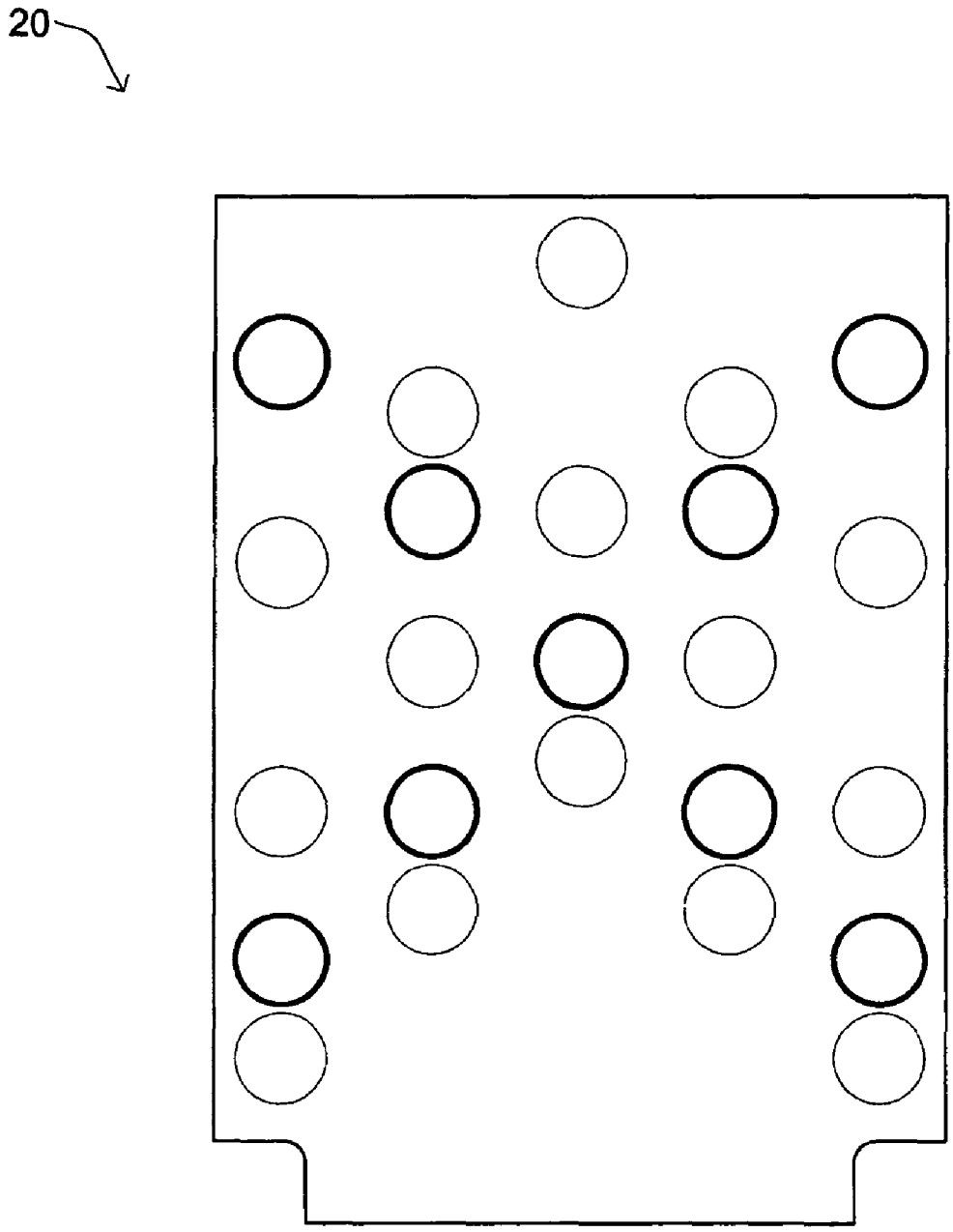
FIGS. 7-8*c* are various views showing the illuminated patterns displayed when the signal device is placed in several orientations according to one embodiment of the present invention.

The illustrated embodiment is configured primarily for vehicular traffic control. It includes red LEDs 21A that form a first pattern comprising an "X" as best shown in FIG. 7 as indicated by the circles having the darker lines. The microprocessor is typically configured to flash the red LEDs when the orientation sensor is upwardly orientated. The flashing attracts attention to the device and increases the probability it will be noticed by an oncoming motorist. In the illustrated embodiment, nine red LEDs form the "X" pattern.

Figure 8A:
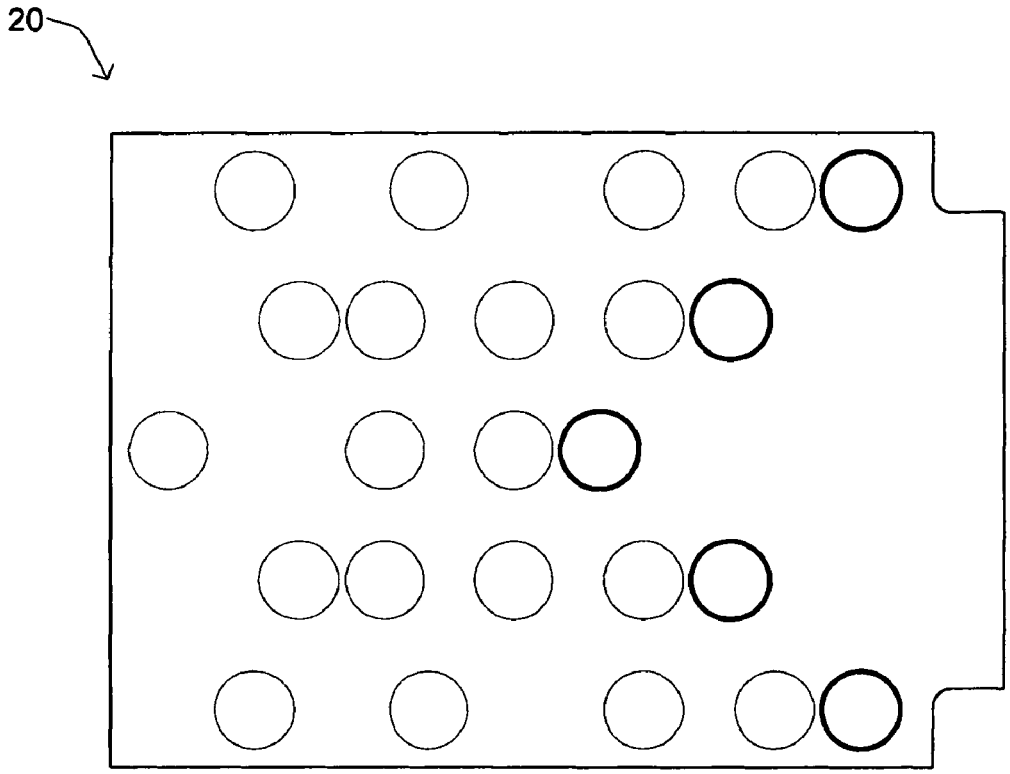
Figure 8B:
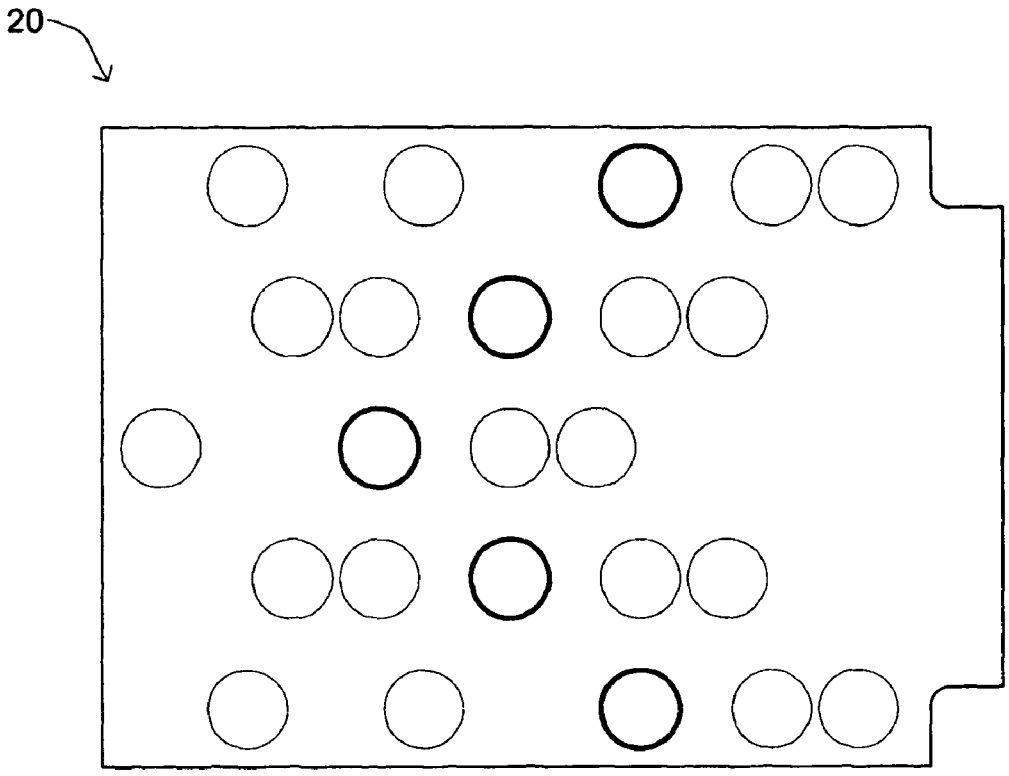
Figure 8C:
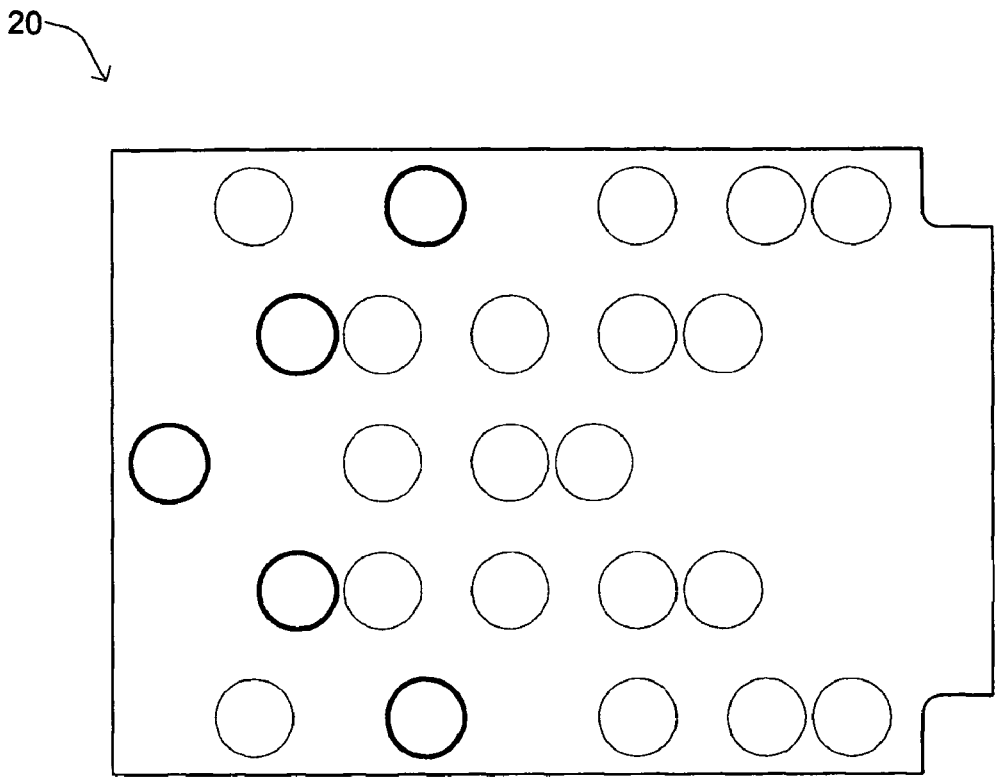

The device further includes 15 green LEDs 21B that when illuminated form three distinct arrows or pointers as illustrated in FIGS. 8A-C. The microcontroller is typically configured to sequentially illuminate and turn off each pointer such that the pattern appears to an oncoming motorist as a single pointer that moves outwardly to indicate the desired direction of travel. The circles having the darker lines indicate the sequentially illuminated green LEDs. This animation attracts the attention of oncoming motorists in a similar manner as the flashing "X".

As illustrated in FIG. 5, the circuit can also include a wireless transmitter 42 with an associated antenna 44 for transmitting information concerning the orientation of the device to a slave or auxiliary signal device, such as the device illustrated in FIG. 9. Accordingly, a slave device located remotely from an officer can be used to reinforce the action an officer desires an oncoming motorist to take. In other circumstances, auxiliary signaling devices may be used as the primary means of directing oncoming traffic specifically in situations where it may be too dangerous for an officer to put himself in the flow of traffic. In such a circumstance, an officer using a personal signaling device with a transmitter can control the operation of the auxiliary units from a location adjacent but not in the path of traffic. In yet other variations, a transceiver may be provided with the circuit wherein the signaling device can be switched into either a primary or auxiliary mode. As can be appreciated from the above discussion, in the auxiliary mode the device would receive instruction not from the MEMS orientation sensor 32 but from another signaling device.

The particular operational frequencies of a wireless transmitter 42 and/or transceiver can vary depending on a particular embodiment; however, given the size, the desirability of maintaining a low weight, and a limited necessary range, relatively low power wireless circuitry is desirable. Where obstacles might interfere with wireless transmissions from the wireless transmitter, the slave/auxiliary signal device might be coupled, such as with one or more conductive wires, to receiver unit having a wireless receiver contained therein.

Operation of a Personal Signal Device According to One Embodiment

Figure 6:
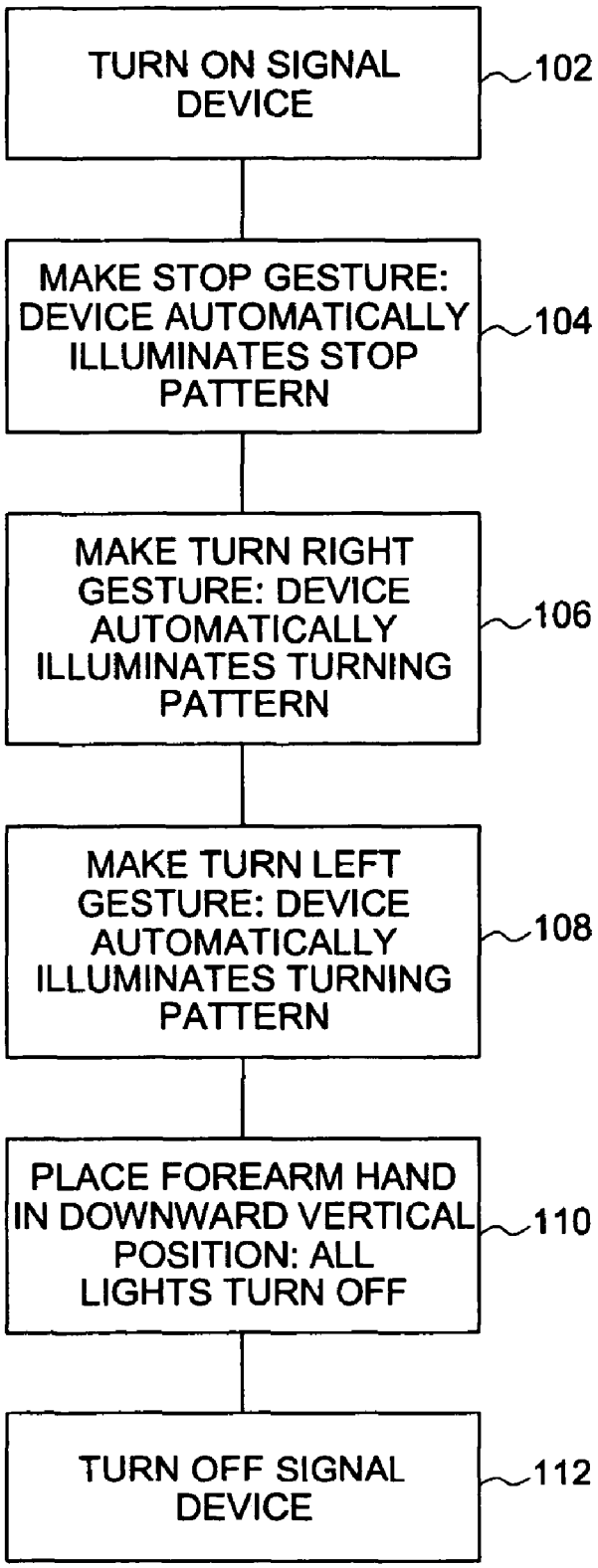
FIG. 6 is a flow chart indicating the operation of the personal signal device according to one embodiment of the present invention.

With reference to the flow chart of FIG. 6, the operation of the device 10 is described with reference to a person, such as a police or traffic officer, wearing the personal signal device on his/her right hand and facing oncoming traffic he/she is directing. Initially, the officer places the glove 12 on his or her right hand and secures the glove in place by closing the closure strap over the cuff. Alternatively, if the device does not include the glove, it can be attached to the user's hand or forearm by any suitable arm attachment means. Further, the officer may hold a signaling unit in his or her hand. As indicated in block 102, the officer turns on the device by depressing the mode key 23. Depending on the orientation of the signaling unit 20 relative to gravity, a pattern of LED lights may be illuminated.

By holding his/her hand vertically upwardly from the forearm typically in front of his/her body with the hand also extended upwardly in a standard gesture indicating an oncoming motorist should stop, the device will automatically display the flashing "X" pattern as indicated in the block 104. In at least one variation, the "X" pattern only flashes for a few seconds after the glove is placed in this particular orientation where after the pattern remains illuminated for an extended period of time, such as 10 seconds or so, after which it flashes again for a couple seconds. It is to be appreciated that in alternative embodiments the pattern itself can vary, as well as, the nature of flashing and the timings associated with the flashing. In one variation, the animated nature of the pattern may be user configurable, such as by way of a computer connected to the signaling unit by a USB cable.

By holding his/her hand outwardly to his or her right to indicate a direction in which an oncoming motorist may proceed, the device will automatically display the animated pointers as indicated in block 106. In one variation, the animated pointers continue to flash sequentially as long as the officer holds his/her hand and arm in this position. As with the stop pattern above, it is to be understood a different illuminated patterns other than is illustrated may be specified to indicate the direction the officer desires a motorists to travel. Additionally the nature of the patterns animation may vary and the animation may also be user configurable.

By extending his/her arm across the body to the left with the palm of the hand facing outwardly towards oncoming motorists, the device will also automatically display the animated pointers as indicated in block 108. The pointers illuminate in much the same manner as when the officer is extending his/her arm to the right. The animated pointers move sequentially from the bottom of the signaling unit to the top of the signaling unit, which corresponds to an outwardly and leftwardly moving pointer when the officer's arm is in the prescribed position.

As indicated by block 110, if an officer moves his/her hand and 20 to a vertically downwardly position with the top of the signaling unit being located below the bottom of the signaling unit, all the LEDs turn off. An officer can also turn the unit off by depressing the mode button 23 as indicated in block 112.

Because it is understood that occasionally an officer will momentarily move his/her arm out of the position necessary to illuminate a desired pattern when he or she does not desire a new pattern to be displayed or for the LEDs to be turned off, some variations of the device include a delay feature; wherein, the device will not switch from one pattern to another until a certain amount of time has passed. Alternatively, the device may stop displaying a particular pattern as soon as the orientation sensor indicates the device is no longer in the proper position, but the device may not display a new pattern based on the orientation of the device until a certain predetermined period of time has passed. Accordingly, the likelihood that such inadvertent or momentary movements of the officer's arm and the attendant change in illuminated patterns will confuse an oncoming motorist is reduced.

It is to be further appreciated, that an officer may wear or attach a personal signal device to each hand or forearm permitting him/her to direct two lanes of traffic: one lane to his or her left; and one lane to his or her right. Furthermore, one or more slave or auxiliary signaling devices may be utilized that are wirelessly coupled with the device in the officer's possession. Accordingly, when the officer signals to stop, the auxiliary device also signals a stop pattern. When the officer signals to turn left or right, the auxiliary device also indicates that an oncoming motorist is to proceed to the left or right respectively.

Embodiments of Paddle-Type Personal Signal Devices

Figure 11:
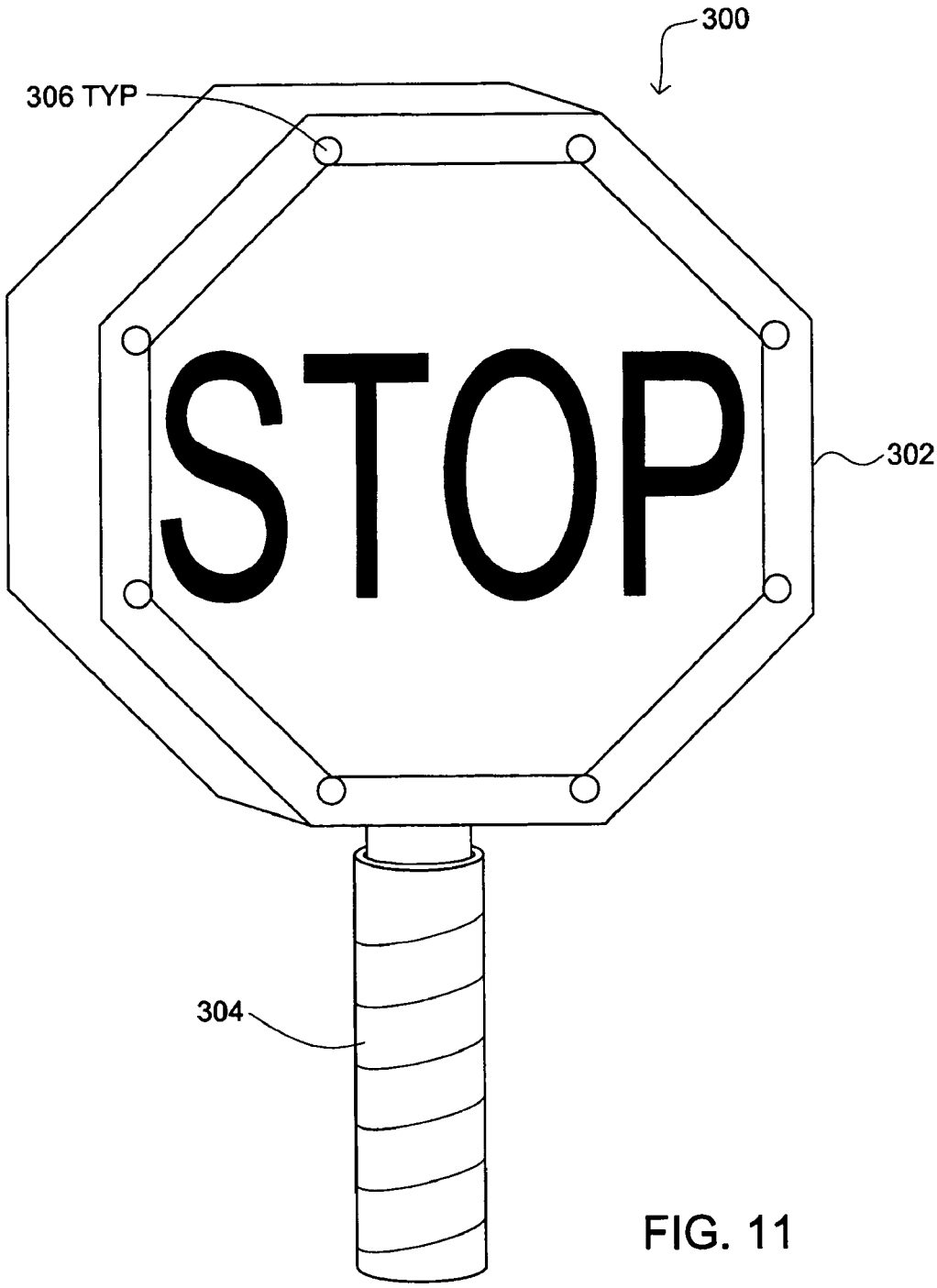
FIG. 11 is an isometric view of a paddle-style signal device according to one embodiment of the present invention.

FIG. 11 comprises a paddle-type personal signal device 300. Instead of being attached to an officer's arm or hand, this device is held by an officer at a handle 304 that extends from the paddle portion 302 of the device. A plurality of LED lights 306 can be located on the front or back faces of the paddle portion. The lights can be arranged in any suitable pattern, and as illustrated, the paddle portion may include signage, such as a stop sign facsimile. The electrical circuitry of the paddle style signal device is typically very similar to that of the glove-based device described above.

The illustrated variation 300 is contemplated for use by crossing guards optionally in conjunction with the one or more auxiliary signaling devices, such as but not limited to a cone-based signal device shown in FIG. 9. Operationally, when positioned upwardly, red LED lights 306 surrounding the stop sign paddle illuminate and optionally flash or blink and the letters forming the word "stop" may also be illuminated. When in this position, any auxiliary signal devices within range of the paddle will display an illuminated stop pattern. This will signal to oncoming traffic that they should stop to permit pedestrians to cross the road.

When the paddle is positioned horizontally, the red LEDs turn off and the auxiliary signal devices will typically display a caution pattern, such as a yellow "X". This pattern signals to oncoming motorists that they may proceed through the crosswalk but should do so with caution. It is expected a crossing guard might place his/her paddle in this position when there are pedestrians, such as children, present at the edge of the road but the crossing guard has not yet stopped the flow of traffic so that the pedestrians may cross safely.

When the panel is positioned downwardly, such that the word "stop" is upside down, the lights on the paddle and the auxiliary signal devices turn off and remain off. Accordingly traffic can proceed normally through the crosswalk. The foregoing operational characteristics of this particular variation of a paddle type signaling device are merely exemplary and are not intended to limit the scope of any other signaling devices.

Auxiliary Signal Devices

Figure 10:
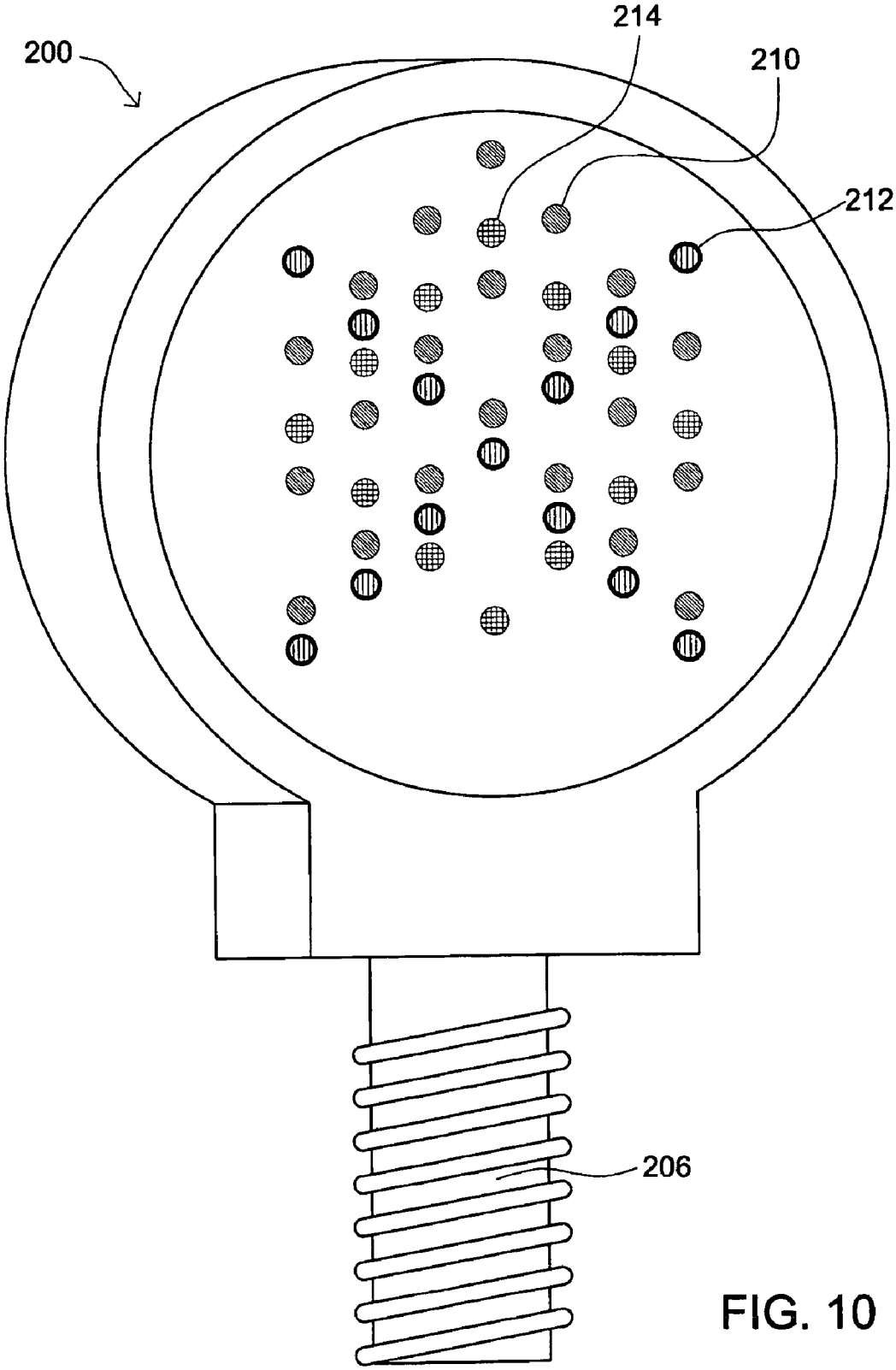
FIG. 10 is an isometric view of the signaling unit of the signal device of FIG. 9 according to one embodiment of the present invention.

FIGS. 9 & 10 are illustrations of a cone-based signaling device 200. Essentially, it comprises a paddle or plate-type signaling unit 202 attached to the top of a traffic cone 204. Typically, a plurality of LED lights are arranged on at least one face thereof. Like the other variations and embodiments described herein, the plurality of lights may comprise lights of various colors that can form a variety of patterns when selectively illuminated.

In one variation, the signaling unit 202 screws into the top of the cone by way of a threaded elongated extension 206 that extends out form a bottom side thereof. In other variations, an extension may be frictionally received in an opening on the top of the cone 204. Regardless, the extension is typically sized such a person can hold it in his/her hand, and as necessary, use the signaling unit as a handheld paddle type-signal device.

The electronic circuitry of an auxiliary signal device is generally similar to that of the glove-based device 10 described herein with some notable exceptions. For instance in an auxiliary signal device that is configured merely to act as a slave, there may be no orientation sensor. Additionally, the device typically includes a receiver instead of a transmitter. The microcontroller in such a variation determines which pattern to illuminate based on signals received from a master signal device, such as the glove-based device 10.

Another variation can include an orientation sensor and a transceiver. Accordingly, this variation can be used as both a cone-based signaling device and a handheld signaling device. Also, with the incorporation of a transceiver it can function either as a master or slave. Operation as a master, however, would probably be limited to those instances when an officer or other person is holding the signaling unit in his/her hand.

Although not illustrated herein, a mode switch is typically provided on the backside of the unit. In addition to turning the unit on and off, the switch may permit a user to select a particular mode of operation and/or a particular illuminated pattern that the device is to continuously display when not in slave or automatic mode. For instance, the cone-based signaling device could be set to display a caution symbol and left unattended at a construction site or even a crosswalk.

Because of the larger size of the device's face when compared with the glove-based unit, a larger number of patterns in a greater array of colors can be provided. As shown in FIG. 10, the illustrated unit comprises LEDs of three different colors: red LEDs 212; green LEDs 210; and yellow LEDs 214. In addition to patterns similar to those described above, yellow pointers can be displayed on the devices face using some of the yellow LEDs to indicate a motorist should proceed with caution. Additionally, a yellow general caution symbol can be displayed using other yellow LEDs, which would indicate that a motorist proceed forwardly in a cautious manner. Some or all of the patterns may have correspondence to particular patterns displayed on a master signal device.

While the illustrated auxiliary device is cone-based, it is contemplated that different variations and styles of the auxiliary signal devices can be produced. For instance, the device could comprise a sign which is attached to a post that is secured in the ground, or the sign can be attached to a telephone pole or lamppost. In yet another variation, an auxiliary signal device can be incorporated into a safety vest that provides more frontal real estate to display larger and more eye-catching patterns. Similarly, a master or primary signal device can include an orientation sensor that is held or attached to an officer proximate his/her hand and a vest with the LED lights distributed thereon rather than having LED lights located with the orientation sensor.

Other Embodiments and Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance as previously indicated, embodiments of the signal device are not intended to be limited for use by police officers and/or crossing guards. Rather, devices with potentially different patterns can be used in a multitude of different situations where movement of a person's hand or other appendage is used to notify or signal another.

I claim:

1. An apparatus comprising:

a glove having a front side, a rear side and a cuff;

a first signaling unit attached to the glove, the signaling unit including, a plurality of lights, an orientation sensor capable of sensing up, down and sideways positions, a power supply, an electrical circuit operatively coupling the plurality of lights, the orientation sensor and the power supply wherein a first illuminated pattern of lights of the plurality of lights is displayed when the first signaling unit is orientated in an up position and a second illuminated pattern of lights is displayed when the signaling unit is orientated in a sideways position.

2. The apparatus of claim 1, wherein the plurality of lights include at least a first set of light emitting diodes (LEDs) having of a first color and a second set of LEDs having a second color, the second color being different than the first, the first set forming the first illuminated pattern and the second set forming the second illuminated pattern.

3. The apparatus of claim 1, wherein the signaling device is coupled with the front side of the glove.

4. The apparatus of claim 3, wherein the signaling device is attached to the cuff and extends generally downwardly from the cuff and away from the front side fo the glove.

5. The apparatus of claim 4, wherein the signaling device includes a generally planar front side having the plurality of lights located thereon and a back side, the back side being coupled to the cuff, a plane of the front side being orientated at an acute angle relative to a plane of the back side.

6. The apparatus of claim 1, wherein the cuff comprises a semi-stiff strap having a width of 1.5-2.5" wide.

7. The apparatus of claim 1, wherein the orientation sensor comprises a MEMS and the signaling device further comprises a microcontroller, the microcontroller adapted to receive orientation signals from the MEMS and activate or deactivate the first or second illuminated pattern.

8. The apparatus of claim 7, wherein (i) the first illuminated pattern comprises a pointer, (ii) the first color is green, (iii) the second illuminated pattern comprises an "X", (iv) the second color is red, and (v) the controller is programmed to (a) display the first illuminated pattern when the first signal device is orientated sideways, (b) display the second illuminated pattern when the first signal device is orientated in an up position, and (c) display neither pattern when the first signal device is orientated in a down position.

9. The apparatus of claim 1, wherein the power supply comprises a rechargeable battery, and the first signal device further includes a USB-type recharging port.

10. The apparatus of claim 7, wherein the controller is adapted to apply a delay for a predetermined amount of time when the first signal device is moved from one orientation to another before changing between illuminated patterns.

11. The apparatus of claim 1 further comprising a wireless transmitter, the wireless transmitter being operatively coupled with the electrical circuit.

12. A system comprising the apparatus of claim 11 and a second signal device, the second signal device including a second plurality of lights, a wireless receiver, a second power supply, a second electrical circuit operatively coupling the second plurality of lights, the wireless receiver and the second power supply wherein in use the wireless receiver receives wireless signals from the first signal device causing (i) a third illuminated pattern of lights of the second plurality of lights to be displayed on the second signal device when the first signaling unit is orientated in an up position and (ii) a fourth illuminated pattern of lights to be displayed on the second signal device when the signaling unit is orientated in a sideways position.

13. A method of directing traffic by a person using an automatic signal device, the automatic signal device comprising a plurality of lights, an orientation sensor capable of sensing up, down and sideways positions, a power supply, an electrical circuit operatively coupling the plurality of lights, the orientation sensor and the power supply, the method comprising:

causing the signal device to automatically display a second illuminated pattern of lights of the plurality of lights when the person orientates the signaling unit in a sideways position by extending an arm with a hand and a forearm laterally from the body in a first direction the person desires the traffic to flow while the signal device is either attached to the arm or held in the hand; and causing the signal device to automatically display a first illuminated pattern of lights when the person orientates the signaling unit is an up position by moving the forearm into an upwardly vertical orientation while the signal device is either attached to the arm or held in the hand.

14. The method of claim 13 further comprising causing the plurality of lights to automatically turn off when the person orientates the signaling unit in a down position by moving the forearm into a downwardly vertical orientation while the signal device is either attached to the arm or held in the hand.

15. The method of claim 14 further comprising causing the signal device to automatically display a second illuminated pattern of lights of the plurality of lights when the person orientates the signaling unit in a sideways position by extending the arm laterally from the body in a second direction the person desires the traffic to flow while the signal device is either attached to the arm or held in the hand.

16. The method of claim 13, further comprising delaying the switching between the second and first illuminated patterns of lights for a predetermined period of time when the arm is moved from one position to another position.

17. The method of claim 13, further comprising an auxiliary signal device that is in wireless communication with the automatic signal device to display different patterns corresponding to patterns displayed by the automatic signal device when the person moves the automatic signal device into specified orientations.

18. The method of claim 17, wherein the auxiliary signal device comprises a signaling unit mounted to or proximate the apex of a traffic cone.

19. An apparatus comprising:

a glove having a front side, a rear side and a cuff; and a first signaling unit attached with the front side of the glove at the cuff extending generally downwardly from the cuff and away from the front side of the glove, the signaling unit including, (i) a plurality of lights of LED lights, the plurality of LED lights including at least a first set having of a first color and a second set having a second color, the second color being different than the first, the first set forming a first pattern when illuminated and the second set forming a second pattern when illuminated, (ii) a MEMS orientation sensor capable of sensing up, down and sideways positions, (iii) a power supply, (iv) an microcontroller, the microcontroller being adapted to receive orientation signals from the MEMS orientation sensor and activate or deactivate the first or second illuminated pattern, (v) an electrical circuit operatively coupling the plurality of LED lights, the MEMS orientation sensor, the microcontroller and the power supply, and (vi) a housing having generally planar front and back sides, the back side abutting the cuff and a plane of the front side being orientated at an acute angle relative to a plane of the back side;

wherein a first illuminated pattern of lights of the plurality of lights is displayed when the first signaling unit is orientated in an up position and a second illuminated pattern of lights is displayed when the signaling unit is orientated in a sideways position.

20. The apparatus of claim 19, wherein (i) the first illuminated pattern comprises a pointer, (ii) the first color is green, (iii) the second illuminated pattern comprises an "X", (iv) the second color is red, and (v) the controller is programmed to (a) display the first illuminated pattern when the first signal device is orientated sideways, (b) display the second illuminated pattern when the first signal device is orientated in an up position, and (c) display neither pattern when the first signal device is orientated in a down position.

* * * * *